US005466656A

United States Patent [19]

Okimoto et al.

[11] Patent Number: 5,466,656

[45] Date of Patent: Nov. 14, 1995

[54] HEAT SENSITIVE RECORDING MATERIAL

[75] Inventors: Tomoyuki Okimoto, Yokohama; Kazumi Maki, Neyagawa; Katsuhiko Ishida, Kashiwa, all of Japan

[73] Assignee: New Oji Paper Company, Ltd., Tokyo, Japan

[21] Appl. No.: 310,500

[22] Filed: Sep. 22, 1994

[30] Foreign Application Priority Data

Sep. 22, 1993 [JP] Japan ..... 5-236765

[51] Int. Cl.[6] ..... B41M 5/30

[52] U.S. Cl. ..... 503/217; 503/221; 503/225

[58] Field of Search ..... 427/150, 151; 503/216, 217, 221, 225

[56] References Cited

U.S. PATENT DOCUMENTS 4,939,269 7/1990 Ohtsubo et al. ..... 548/308

*Primary Examiner*—B. Hamilton Hess

*Attorney, Agent, or Firm*—Nikaido, Marmelstein, Murray & Oram

[57] ABSTRACT

The present invention provides a heat sensitive recording material comprising a recording layer formed on a substrate and containing a colorless or light-colored basic dye and a color acceptor, the material being characterized in that the basic dye is 3-(N-ethyl-N-p-tolyl)amino-6-methyl-7-p-toluidinofluoran, the color acceptor is bis(3-allyl-4-hydroxyphenyl)sulfone and/or 4-hydroxy-4'-isopropoxydiphenylsulfone.

4 Claims, No Drawings

HEAT SENSITIVE RECORDING MATERIAL

The present invention relates to heat sensitive recording materials which are especially excellent in readability by a semiconductor laser and which are satisfactory in the preservability of recorded images and free of background fogging.

Heat sensitive recording materials are well known which utilize the reaction between a colorless or light-colored basic dye and a color acceptor for producing recorded images by thermally reacting the two chromogenic substances. Such recording materials are relatively inexpensive, are usable with a recording device which is compact and free of maintenance and are therefore in use in a wide variety of fields.

For example, POS (Point of Sales) label systems are placed into use in various fields, while He—Ne lasers are chiefly in common use as light sources for bar code readers. The reading wavelengths thereof are mainly in the vicinity of 630 nm, and leuco dyes of black color generally used conventionally are fully useful for reading. Further in the case of semiconductor lasers which primarily have oscillation wavelengths of around 900 nm, special near infrared chromogenic dyes corresponding to these wavelengths have been used, whereas such dyes have the drawback of being susceptible to background coloration with lapse of time. However, with advances made in production techniques in recent years, it has become possible to readily produce semiconductor lasers having oscillation wavelengths around 670 nm and highly useful. These lasers are considered promising as light sources for reading bar codes. The conventional black chromogenic dyes are nevertheless not satisfactory for use with these lasers; they are slightly narrower in absorption wavelength range, fail to fully absorb light at about 670 nm and therefore to permit reading with required sensitivity and are prone to reading errors.

Accordingly, it is strongly desired to provide a heat sensitive recording material which is at least 670 nm to about 700 nm in absorption wavelength for use with bar code readers having a semiconductor laser and which has a recording layer not permitting is blank area to become impaired in whiteness, the material further being capable of retaining recorded images with good stability.

An object of the present invention is to provide a heat sensitive recording material which is readable with high stability by a bar code reader incorporating a semiconductor laser which has oscillation wavelengths in the vicinity of 670 nm.

The above and other objects of the invention will become apparent from the following description.

The present invention provides a heat sensitive recording material comprising a recording layer formed on a substrate and containing a colorless or light-colored basic dye and a color acceptor, the material being characterized in that the basic dye is 3-(N-ethyl-N-p-tolyl)amino-6-methyl-7-p-toluidinofluoran, the color acceptor is bis(3-allyl-4-hydroxyphenyl)sulfone and/or 4-hydroxy-4'-isopropoxydiphenylsulfone.

In the present invention, we have carried out extensive research and consequently found that the combination of a specific basic dye and a specific color acceptor provides a heat sensitive recording material having satisfactory absorption wavelengths of about 670 nm to about 700 nm and less likely to become impaired in whiteness and recording density. Thus, the present invention has been accomplished.

According to the invention, we have found a heat sensitive recording material having fully strong absorption at about 670 nm to about 700 nm in wavelength is obtained by using 3-(N-ethyl-N-p-tolyl)amino-6-methyl-7-p-toluidinofluoran as a basic dye and bis(3-allyl-4-hydroxyphenyl)sulfone and/or 4-hydroxy-4'-isopropoxydiphenylsulfone as a color acceptor. More specifically, the recording material was found to be up to 23% in the reflectance of colored areas and at least 95% in the reflectance of blank areas, hence a contrast satisfactorily readable by semiconductor bar code readers. The recording material has stronger absorption wavelengths in the vicinity of 700 nm and are more favorably usable especially when the color acceptor used is bis(3-allyl-4hydroxyphenyl)sulfone.

It is desired that the ratio of the color acceptor to the basic dye to be used therewith be adjusted generally within the tangle of 50 to 1000 parts by weight, preferably about 150 to about 700 parts by weight, per 100 parts by weight of the basic dye although not limited specifically.

According to the invention, the above-specified basic dye and color acceptor used in combination as the components of the chromogenic system provide a heat sensitive recording material which is satisfactorily readable by the bar code reader having a semiconductor laser, whereas when the material is subjected, for example, to a high-temperature high-humidity environment, the recording density will decrease to result in reading errors. It is desired to incorporate preservability improving agents, such as those given below, to the recording layer since the heat sensitive recording material then obtained is further improved in the preservability of recorded images and is excellent in readability.

Examples of useful preservability improving agents are 2,2'-methylenebis(4-methyl-6-tert-butylphenol), 2,2'-methylenebis-(4-ethyl-6-tert-butylphenol), 2,2'-methylenebis-(4,6-di-tert-butylphenol), 2,2'-ethylidenebis(4-sec-butyl-6-tert-butylphenol), 4,4'-butylidenebis(6-tert-butyl-3-methylphenol), 4,4'-thiobis(6-tert-butyl-3-methylphenol), 1,1,3-tris(5-tert-butyl-4-hydroxy-2-methylphenyl)butane, 1,1,3-tris(5-cyclohexyl-4-hydroxy-2-methylphenyl)butane, 1,3,5-tris[2-(3,5-di-tert-butyl-4-hydroxyhydrocinnamoyloxy)-ethyl]isocyanurate, 1,3,5-tris(4-tert-butyl-3-hydroxy-2,6-dimethylbenzyl)isocyanurate, 1,3,5-tris(3,5-di-tert-butyl-4-hydroxybenzyl)isocyanurate, 2,4,6-tris(3',5'-di-tert-butyl-4'-hydroxybenzyl)mesitylene, pentaerythrityl-tetrakis [3-(3,5-di-tert-butyl-4-hydroxyphenyl)propionate], 4-{4-[1,1-bis(4-hydroxyphenyl)ethyl]-α,α -dimethylbenzyl}phenol, metal salt of 2,2'-methylenebis(4,6-di-tert-butylphenyl)phosphate, etc. At least two of these compounds can be used in combination as required. As metal salt of 2,2'-methylenebis(4,6-di-tert-butylphenyl)phosphate, preferable are sodium, potassium and like alkali metal salt, and a polyvalent metal salt such as magnesium, calcium, barium, zinc and aluminum salt.

Among the above preservability improving agent, preferably used are a metal salt of 2,2'-methylenebis(4,6-di-tert-butylphenyl)phosphate, 1,1,3-tris(5-tert-butyl-4hydroxy-2-methylphenyl)butane, 1,1,3-tris(5-cyclohexyl-4-hydroxy-2–methylphenyl)butane and 4-{4-[1,1-bis(4-hydroxyphenyl)ethyl]-α,α -dimethylbenzyl{phenol, which exhibit particularly excellent effect in combination with the above specific basic dye and the specific color acceptor.

It is desired that the ratio of the preservability improving agent to the basic dye to be used therewith be adjusted generally within the range of 10 to 700 parts by weight, preferably about 30 to about 350 parts by weight, per 100 parts by weight of the basic dye although not limited specifically.

As previously described, the heat sensitive recording material of the present invention has the important feature that the chromogenic system thereof comprises the specified basic dye and color acceptor. When required, it is further possible to use these components in combination with basic dyes disclosed, for example, in JP-A-353491/1992 and color acceptors disclosed, for example, in JP-A-580/1993.

Further, it is possible to use heat-fusible substances insofar as they are not detrimental to the contemplated effect of the present invention.

Examples of useful heat-fusible substances are stearic acid amide, stearic acid methylenebisamide, stearic acid ethylenebisamide, stearic acid methylolamide, oleic acid amide, palmitic acid amide, coconut fatty acid amide and like fatty acid amides, p-benzylbiphenyl, 1,2-bis(phenoxy-)ethane, 1,2-bis(3-methylphenoxy)ethane, 1,2-bis(4-methylphenoxy)ethane, 2-naphthyl benzyl ether, benzyl-4-methylthiophenyl ether and like ethers, dibenzyl terephthalate, 1-hydroxy-2-naphthoic acid phenyl ester, oxalic acid di-p-methylbenzyl ester, oxalic acid di-p-chlorobenzyl ester and like esters.

A coating composition is prepared from these components, for example, by dispersing the dye and color acceptor, and the preservability improving agent and heat-fusible substance which are used when so required, into a dispersion medium which is generally water, at the same time or individually, with use of a stirring-pulverizing machine such as a ball mill, attritor, vertical or horizontal sand mill or colloid mill.

Usually a binder is incorporated into the coating composition in an amount of 2 to 40 wt. %, preferably about 5 to about 25 wt. %, based on the total solids content of the composition. Examples of useful binders are starches,, hydroxyethyl cellulose, methyl cellulose, carboxymethyl cellulose, gelatin, casein, gum arabic, polyvinyl alcohol, carboxyl-modified polyvinyl alcohol, sulfo-modified polyvinyl alcohol, acetoacetyl-modified polyvinyl alcohol, silicon-modified polyvinyl alcohol and like modified polyvinyl alcohols, styrene-maleic anhydride copolymer salt, ethyleneacrylic acid copolymer salt, styrene-acrylic acid copolymer salt, styrene-butadiene copolymer emulsion, etc. At least two of these binders can of course be used in combination.

Various auxiliary agents can further be added to the coating composition. Examples of useful agents are dispersants such as sodium dioctylsulfosuccinate and metal salts of fatty acids, ultraviolet absorbers of the benzotriazole, benzophenone, cyanoacrylate, hydroxybenzoate and like types, and other agents including defoaming agents, fluorescent dyes and coloring dyes.

To prevent the heat sensitive recording material from sticking to the recording device or recording head on contact therewith, it is possible to add to the composition a dispersion or emulsion of stearic acid ester wax, polyethylene wax, carnauba wax, microcrystalline wax, carboxyl-modified paraffin wax, zinc stearate, calcium stearate or the like.

To diminish the adhesion of tailings to the recording head, it is also possible to add to the composition an inorganic pigment such as kaolin, clay, talc, calcium carbonate, magnesium carbonate, calcined clay, titanium oxide, kieselguhr, finely divided anhydrous silica or activated clay, and organic pigment such as styrene microballs, nylon powder, polyethylene powder, urea-formalin resin filler or crude starch particles.

With the heat sensitive recording material of the invention, the method of forming the recording layer is not limited specifically. The recording layer can be formed by known conventional techniques, for example, by applying a coating composition for forming this layer to a substrate with a suitable coater, such as air knife coater, blade coater, bar coater, gravure coater or curtain coater, and drying the resulting coating.

The amount of coating composition to be applied is not limited specifically either. Generally it is adjusted to the range of 1.0 to 12 g/m$^2$, preferably 1.5 to 10 g/m$^2$, by dry weight.

While the substrate to be used is usual paper, plastics film, synthetic paper or the like, paper is the most preferable to use in view of cost and coatability.

The heat sensitive recording material of the present invention thus obtained exhibits the excellent characteristics of having satisfactory absorption wavelengths of about 670 nm to about 700 nm and less likely to become impaired in recording density and whiteness.

When required, it is of course possible to form a protective layer over the front surface and/or rear surface of the heat sensitive recording material, or to provide an intermediate layer between the substrate and the heat sensitive recording layer. The material can further be additionally treated by various techniques known in the art of preparing heat sensitive recording materials, such as application of an adhesive thereto.

The present invention will be described in greater detail with reference to the following examples, to which the invention is not limited. The parts and percentages in these examples are by weight unless otherwise specified.

EXAMPLE 1

(1) Formation of intermediate layer

A coating composition for an intermediate layer was prepared by mixing together 100 parts of calcined clay (brand name: Ansilex, product of Engelhard Minerals & Chemicals Corp.), 15 parts of styrene-butadiene copolymer latex (solids content: 50%), 30 parts of 10% aqueous solution of polyvinyl alcohol and 200 parts of water. The coating composition obtained was applied to wood-free paper, weighing 50 g/m$^2$, in an amount of 7 g/m$^2$ when dried, followed by drying to form an intermediate layer.

(2) Preparation of Composition A

A composition comprising 10 parts of 3-(N-ethyl-N-p-tolyl)amino-6-methyl-7-p-toluidinofluoran, 20 parts of 1,2-bis(3-methylphenoxy)ethane, 10 parts of 5% aqueous solution of methyl cellulose and 60 parts of water was pulverized to a mean particle size of 0.7 μm by a sand mill.

(3) Preparation of Composition B

A composition composed of 30 parts of bis(3-allyl-4-hydroxyphenyl)sulfone, 50 parts of 5% aqueous solution of methyl cellulose and 20 parts of water was pulverized to a mean particle size of 1.2 μm by a sand mill.

(4) Formation of heat sensitive recording layer

A coasting composition for forming a heat sensitive recording layer was prepared by mixing together with stirring 100 parts of Composition A, 100 parts of Composition B, 180 parts of 10% aqueous solution of polyvinyl alcohol, 20 parts of calcium carbonate and 100 parts of water. The composition obtained was applied onto the intermediate layer in an amount by dry weight of 6 g/m$^2$ and dried.

(5) Formation of protective layer

A coating composition for a protective layer was prepared from 200 parts of 10% aqueous solution of acetoacetyl-modified polyvinyl alcohol (brand name: Gohsefimer Z-200, product of the Nippon Synthetic Chemical Industry Co., Ltd.), 60 parts of kaolin (brand name: UW-90, product of Engelhard Minerals & Chemicals Corp.), 15 parts of 30% aqueous dispersion of zinc stearate and 140 parts of water by mixing these ingredients together with stirring. The coating composition obtained was applied onto the recording layer in an amount by dry weight of 3 g/m$^2$ and dried to obtain a heat sensitive recording material having a protective layer.

EXAMPLE 2

A heat sensitive recording material having a protective layer was prepared in the same manner as in Example 1 except that in preparing Composition B, 30 parts of bis(3-allyl-4-hydroxyphenyl)sulfone was replaced by 25 parts of bis(3-allyl-4-hydroxyphenyl)sulfone and 5 parts of 1,1,3 -tris(5-cyclohexyl-4-hydroxy-2-methylphenyl)butane.

EXAMPLE 3

A heart sensitive recording material having a protective layer was prepared in the same manner as in Example 1 except that in preparing Composition B, 30 parts of bis(3-allyl-4-hydroxyphenyl)sulfone was replaced by 25 parts of 4-hydroxy-4'-isopropoxydiphenylsulfone and 5 parts of a mixture (brand name: Adeka.Arkls F-85, product of Asahi Denka Kogyo Co., Ltd.) of sodium salt of 2,2'-methylenebis(4,6-di-tert-butylphenyl)phosphate and magnesium silicate.

EXAMPLE 4

A heat sensitive recording material having a protective layer was prepared in the same manner as in Example 2 except that in preparing Composition A, 10 parts of 3 -(N-ethyl-N-p-tolyl)amino-6-methyl-7-p-toluidinofluoran was replaced by 5 parts of 3-(N-ethyl-N-p-tolyl)amino-6-methyl-7 -p-toluidinofluoran and 5 parts of 3-di(n-butyl)amino-6-methyl-7-anilinofluoran.

EXAMPLE 5

A heat sensitive recording material having a protective layer was prepared in the same manner as in Example 4 except that in preparing Composition A, 3-di(n-butyl)amino-6-methyl-7-anilinofluoran was replaced by 3-(N-ethyl-N-isopentyl)amino-6-methyl-7-anilinofluoran.

EXAMPLE 6

A heat sensitive recording material having a protective layer was prepared in the same manner as in Example 4 except that tin preparing Composition A, 3-di(n-butyl)amino-6-methyl-7-anilinofluoran was replaced by 3-diethylamino-7-[m-(trifluoromethyl)phenylamino]fluoran, and in preparing Composition B, 30 parts of bis(3-allyl-4-hydroxyphenyl)sulfone was replaced by 25 parts of bis(3-allyl-4-hydroxyphenyl)sulfone and 5 parts of 4-{4-[1,1-bis(4-hydroxyphenyl)ethyl]-α,α-dimethylbenzyl}phenol.

Comparative Example 1

A heat sensitive recording material having a protective layer was prepared in the same manner as in Example 2 except that in preparing Composition B, bis(3-allyl-4-hydroxyphenyl)sulfone was replaced by 4,4'-cyclohexylidenediphenol.

Comparative Example 2

A heat sensitive recording material having a protective layer was prepared in the same manner as in Example 2 except that in preparing Composition B, bis(3-allyl-4-hydroxyphenyl)sulfone was replaced by 2,4'-dihydroxydiphenyl-sulfone.

Comparative Example 3

A heat sensitive recording material having a protective layer was prepared in the same manner as in Example 2 except that in preparing Composition B, bis(3-allyl-4-hydroxyphenyl)sulfone was replaced by 4,4'-dihydroxydiphenyl-sulfone.

Comparative Example 4

A heat sensitive recording material having a protective layer was prepared in the same manner as in Example 2 except that in preparing Composition A, 3-(N-ethyl-N-p-tolyl)amino-6-methyl-7-p-toluidinofluoran was replaced by 3-di(n-butyl)amino-6-methyl-7-anilinofluoran.

Comparative Example 5

A heat sensitive recording material having a protective layer was prepared in the same manner as in Example 2 except that in preparing Composition A, 3-(N-ethyl-N-p-tolyl)amino-6-methyl-7-p-toluidinofluoran was replaced by 3-(N-ethyl-N-isopentyl)amino-6-methyl-7-anilinofluoran.

The eleven kinds of heat sensitive recording materials thus obtained were evaluated by the following methods, and the results obtained are listed in Table 1.

[Recordability and readability].

The heat sensitive recording material was used for recording images by a heat sensitive recording simulator (TH-PMD, product of Ohkura Denki Co., Ltd.) with application of voltage of 24 V having a pulse width of 2.5 ms. The reflection spectra of colored portions of recorded images and blank portions were determined by a spectrophotometer, Model UVIDEC-505 (product of Nippon Bunko Kogyo Co., Ltd.) to evaluate the above properties in terms of the reflectance at a wavelength of 700 nm. The materials were 96 to 99% in the reflectance of blank portions.

[Heat-resistant preservability]

The heat sensitive recording material used for recording was allowed to stand in an atmosphere of 60° C. for 24 hours and thereafter checked for the reflection spectra of colored portions of recorded images and blank portions by the spectrophotometer, Model UVIDEC-505 (product of Nippon Bunko Kogyo Co., Ltd.) to evaluate the preservability in terms of the reflectance at a wavelength of 700 nm.

[Moisture-resistant preservability]

The heat sensitive recording material used for recording was allowed to stand in an atmosphere of 40° C., 90% RH for 24 hours and thereafter checked for the reflection spectra of colored portions of recorded images and blank portions in the same manner as above to evaluate the preservability in terms of the reflectance at a wavelength of 700 nm.

TABLE 1

| | Reflectance of colored portion (%) | | |
|---|---|---|---|
| | without preservability test | heat resistance | moisture resistance |
| Ex. 1 | 10 | 12 | 16 |
| Ex. 2 | 10 | 10 | 12 |
| Ex. 3 | 15 | 15 | 18 |
| Ex. 4 | 17 | 18 | 19 |
| Ex. 5 | 18 | 18 | 18 |

TABLE 1-continued

| | Reflectance of colored portion (%) | | |
|---|---|---|---|
| | without preservability test | heat resistance | moisiture resistance |
| Ex. 6 | 19 | 19 | 19 |
| Com. Ex. 1 | 25 | 43 | 45 |
| Com. Ex. 2 | 28 | 36 | 42 |
| Com. Ex. 3 | 48 | 58 | 64 |
| Com. Ex. 4 | 34 | 36 | 37 |
| Com. Ex. 5 | 35 | 35 | 36 |

The results given in Table 1 reveal that the heat sensitive recording materials obtained in the examples of the invention were excellent in readability by a semiconductor laser and are satisfactory in the preservability of recorded images and free of background fogging, hence excellent recording materials.

We claim:

1. A heat sensitive recording material comprising a recording layer formed on a substrate and containing a colorless or light-colored basic dye and a color acceptor, the material being characterized in that the basic dye is 3-(N-ethyl-N-p-tolyl)amino-6-methyl-7-p-toluidinofluoran, the color acceptor is bis(3-allyl-4-hydroxyphenyl)sulfone and/or 4-hydroxy-4'-isopropoxydiphenylsulfone.

2. A heat sensitive recording material as defined in claim 1 wherein further a preservability improving agent is incorporated in the recording layer.

3. A heat sensitive recording material as defined in claim 2 wherein the preservability improving agent is at least one compound selected from the group consisting of a metal salt of 2,2'-methylenebis(4,6-di-tert-butylphenyl)phosphate, 1,1,3-tris(5-tert-butyl-4-hydroxy-2-methylphenyl)butane, 1,1,3-tris(5-cyclohexyl-4-hydroxy-2-methylphenyl)butane and 4-{4-[1,1-bis(4 -hydroxyphenyl)ethyl]-α,α-dimethylbenzyl}phenol.

4. A heat sensitive recording material as defined in claim 1 wherein further a heat-fusible substance is incorporated in the recording layer.

* * * * *